US008434753B2

(12) United States Patent
Fukatsu et al.

(10) Patent No.: US 8,434,753 B2
(45) Date of Patent: May 7, 2013

(54) SHEET PROCESSING APPARATUS AND IMAGE FORMING APPARATUS

(75) Inventors: Yasuo Fukatsu, Abiko (JP); Hitoshi Kato, Toride (JP); Naoki Ishikawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 8 days.

(21) Appl. No.: 13/178,963

(22) Filed: Jul. 8, 2011

(65) Prior Publication Data

US 2012/0025438 A1 Feb. 2, 2012

(30) Foreign Application Priority Data

Jul. 27, 2010 (JP) ..... 2010-167848

(51) Int. Cl.
*B26D 5/20* (2006.01)

(52) U.S. Cl.
USPC ..... 270/58.07

(58) Field of Classification Search ..... 270/58.07; 271/184, 185, 188; 83/262
See application file for complete search history.

(56) References Cited

U.S. PATENT DOCUMENTS

| | | | | |
|---|---|---|---|---|
| 5,284,333 | A | 2/1994 | Ishikawa | |
| 5,290,021 | A | 3/1994 | Murooka et al. | |
| 5,433,427 | A | 7/1995 | Ishikawa et al. | |
| 5,507,482 | A | 4/1996 | Tenpaku et al. | |
| 5,509,645 | A * | 4/1996 | Shinno et al. | 270/58.17 |
| 5,639,077 | A * | 6/1997 | Hirano et al. | 270/58.12 |
| 6,249,334 | B1 * | 6/2001 | Ui et al. | 355/23 |
| 6,361,036 | B1 * | 3/2002 | Nakazawa | 270/58.07 |
| 6,804,473 | B2 | 10/2004 | Nakamura et al. | |
| 6,813,472 | B2 * | 11/2004 | Aizawa | 399/388 |
| 6,826,374 | B2 | 11/2004 | Kato et al. | |
| 6,997,449 | B2 | 2/2006 | Obuchi et al. | |
| 7,011,306 | B2 | 3/2006 | Kato et al. | |
| 7,050,751 | B2 | 5/2006 | Watanabe et al. | |
| 7,597,311 | B2 | 10/2009 | Kawata et al. | |
| 7,823,875 | B2 | 11/2010 | Fukatsu et al. | |
| 7,891,651 | B2 * | 2/2011 | Wakabayashi et al. | 270/58.17 |
| 7,954,818 | B2 | 6/2011 | Fukatsu et al. | |
| 2011/0012301 | A1 | 1/2011 | Fukatsu et al. | |

FOREIGN PATENT DOCUMENTS

JP 2007-55748 A 3/2007

* cited by examiner

*Primary Examiner* — Leslie A Nicholson, III
(74) *Attorney, Agent, or Firm* — Fitzpatrick, Cella, Harper & Scinto

(57) ABSTRACT

A sheet processing apparatus includes a conveying portion which can move a sheet in a sheet conveying direction and in a sheet width direction, a moving portion which moves the conveying portion in the sheet width direction, a punching portion which punches a hole in the sheet, and a pressing portion which presses an upstream end of the sheet. The sheet forms a first loop to correct skew feeding while the sheet is conveyed with its downstream end abutted against the conveying portion in the sheet conveying direction. The conveying portion conveys the sheet. The moving portion moves the conveying portion in the sheet width direction to correct lateral registration of the sheet. The pressing portion presses an upstream end of the sheet in the sheet conveying direction and forms a second loop of the sheet to correct skew feeding. The sheet is positioned with reference to the pressing portion.

8 Claims, 11 Drawing Sheets

SHEET PROCESSING APPARATUS AND IMAGE FORMING APPARATUS

BACKGROUND OF THE INVENTION

1. Field of the Invention

The present invention relates to a sheet processing apparatus and an image forming apparatus having a punch apparatus that punches a hole in a sheet.

2. Description of the Related Art

Conventionally, some sheet processing apparatuses have a punch apparatus that punches a hole in a sheet one by one while the sheet is conveyed after images are formed on them. Japanese Patent Laid-Open No. 2007-055748 discusses the invention about such a sheet processing apparatus.

The sheet processing apparatus discussed in Japanese Patent Laid-Open No. 2007-055748 includes a lateral registration correcting portion that moves a sheet in a width direction orthogonal to a sheet conveying direction to align with a punch position. More specifically, the sheet processing apparatus discussed in Japanese Patent Laid-Open No. 2007-055748 includes first and second lateral registration correcting portions. The first lateral registration correcting portion corrects the lateral registration based on a lateral registration detection result at the downstream end in the sheet conveying direction. The second lateral registration correcting portion corrects the lateral registration based on a lateral registration detection result at the upstream end in the sheet conveying direction. This configuration prevents lateral registration due to skew feeding of the sheet and highly accurately punches a hole in the sheet.

However, the sheet processing apparatus discussed in Japanese Patent Laid-Open No. 2007-055748 corrects the second lateral registration by switching back a sheet to correct the skew feeding. It takes time from the beginning to the end of the lateral registration correction. As a result, the time to punch a hole in a sheet might become long.

The present invention provides a sheet processing apparatus that can correct skew feeding of sheet and shorten the time to punch a hole in a sheet.

SUMMARY OF THE INVENTION

A sheet processing apparatus according to the present invention includes a conveying portion which conveys a sheet and is capable of moving in a sheet width direction orthogonal to a sheet conveying direction, a moving portion which moves the conveying portion in the sheet width direction, a punching portion which punches a hole in the sheet, and a pressing portion which presses an upstream end of the sheet in the sheet conveying direction while the conveying portion conveys the sheet. The sheet forms a first loop to correct skew feeding while the sheet is conveyed with its downstream end abutted against the conveying portion in the sheet conveying direction. The conveying portion conveys the sheet. The moving portion moves the conveying portion in the sheet width direction to correct lateral registration of the sheet. The pressing portion then presses an upstream end of the sheet in the sheet conveying direction and forms a second loop of the sheet to correct skew feeding. The sheet is positioned with reference to the punching portion.

Further features of the present invention will become apparent from the following description of exemplary embodiments with reference to the attached drawings.

DESCRIPTION OF THE EMBODIMENTS

The following describes embodiments of the present invention in detail with reference to the drawings. Sizes, materials, shapes, and relative positions of constituent parts described in the embodiments are appropriately changed according to configurations and various conditions of the apparatus to which the invention is applied. Therefore, the scope of the invention is not limited to those unless such sizes, materials, shapes, or relative positions are specifically described.

<Embodiment>

Figure 1:
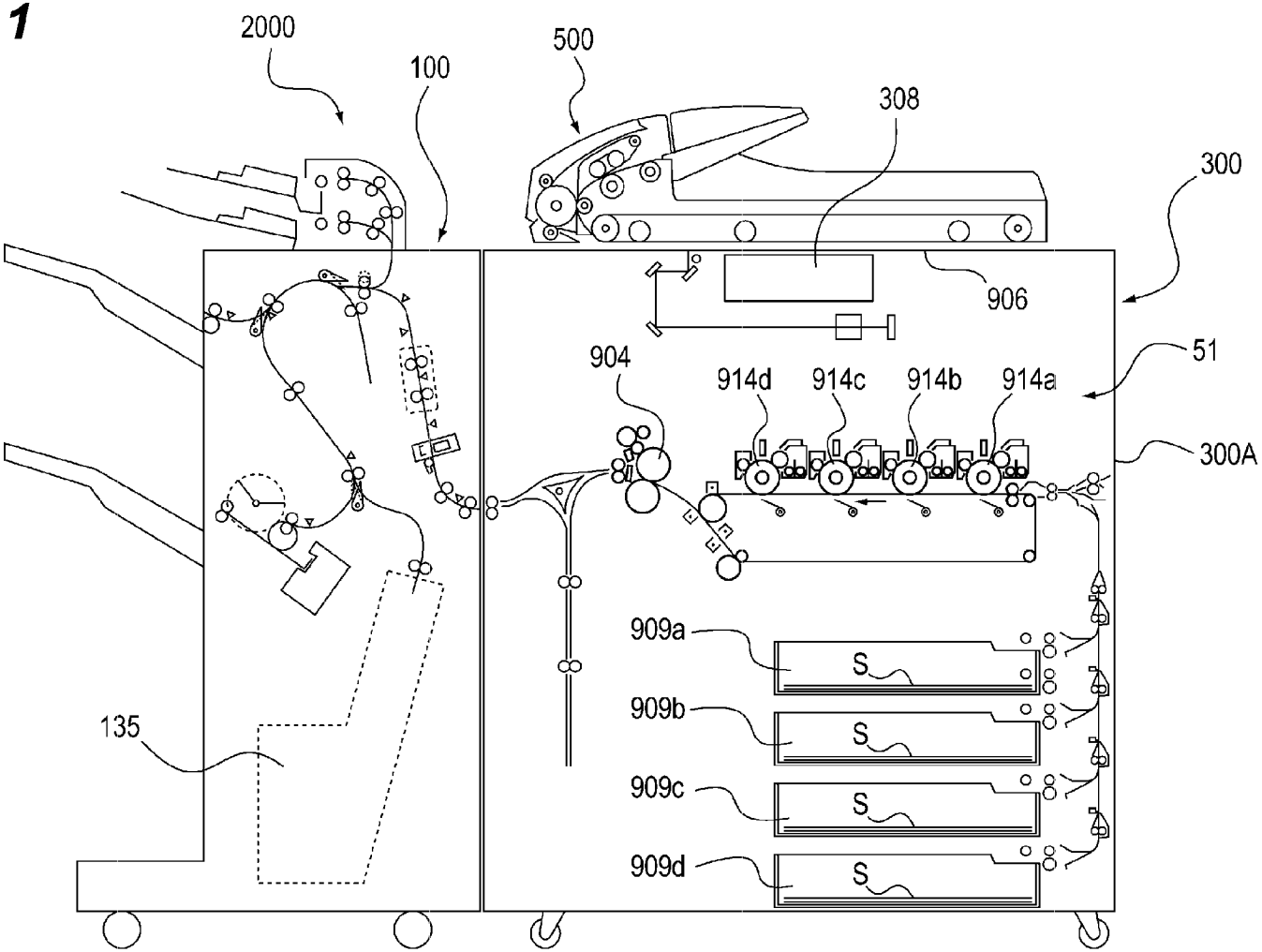
FIG. 1 is a sectional view illustrating a configuration of an image forming system having a sheet processing apparatus according to an embodiment of the invention.

FIG. 1 is a sectional view illustrating a configuration of an image forming system 2000 having a sheet processing apparatus according to an embodiment of the invention. The image forming system 2000 includes an image forming apparatus 300 using electrophotographic image forming processes and a sheet processing apparatus 100. As illustrated in FIG. 1, the image forming apparatus 300 includes an image forming apparatus main body (hereafter referred to as apparatus main body 300A). The apparatus main body 300A is internally provided with an image forming portion 51 that forms an image. The image forming portion 51 includes a photosensitive drum 914 (914*a* through 914*d*) as an image bearing member and a transfer member as a transfer apparatus. At least the photosensitive drum 914 may be included in a process cartridge and, as such, may be built in the apparatus main body 300A.

The image forming system 2000 includes the image forming apparatus 300, an automatic document feeding unit 500, and the sheet processing apparatus 100. The sheet processing apparatus 100 is connected to the image forming apparatus 300 and includes a saddle stitching unit 135, and a side stitching unit as a sheet mounting unit. The sheet processing apparatus 100 and the image forming apparatus 300 may be integrated.

The yellow, magenta, cyan, and black photosensitive drums 914*a* through 914*d* as image forming portions transfer a 4-color toner image to a sheet S fed from cassettes 909*a* through 909*d* in the image forming apparatus 300. The sheet S is conveyed to a fixing device 904 that fixes the toner image to the sheet S. The sheet S is then conveyed to the sheet processing apparatus 100.

Figure 2:
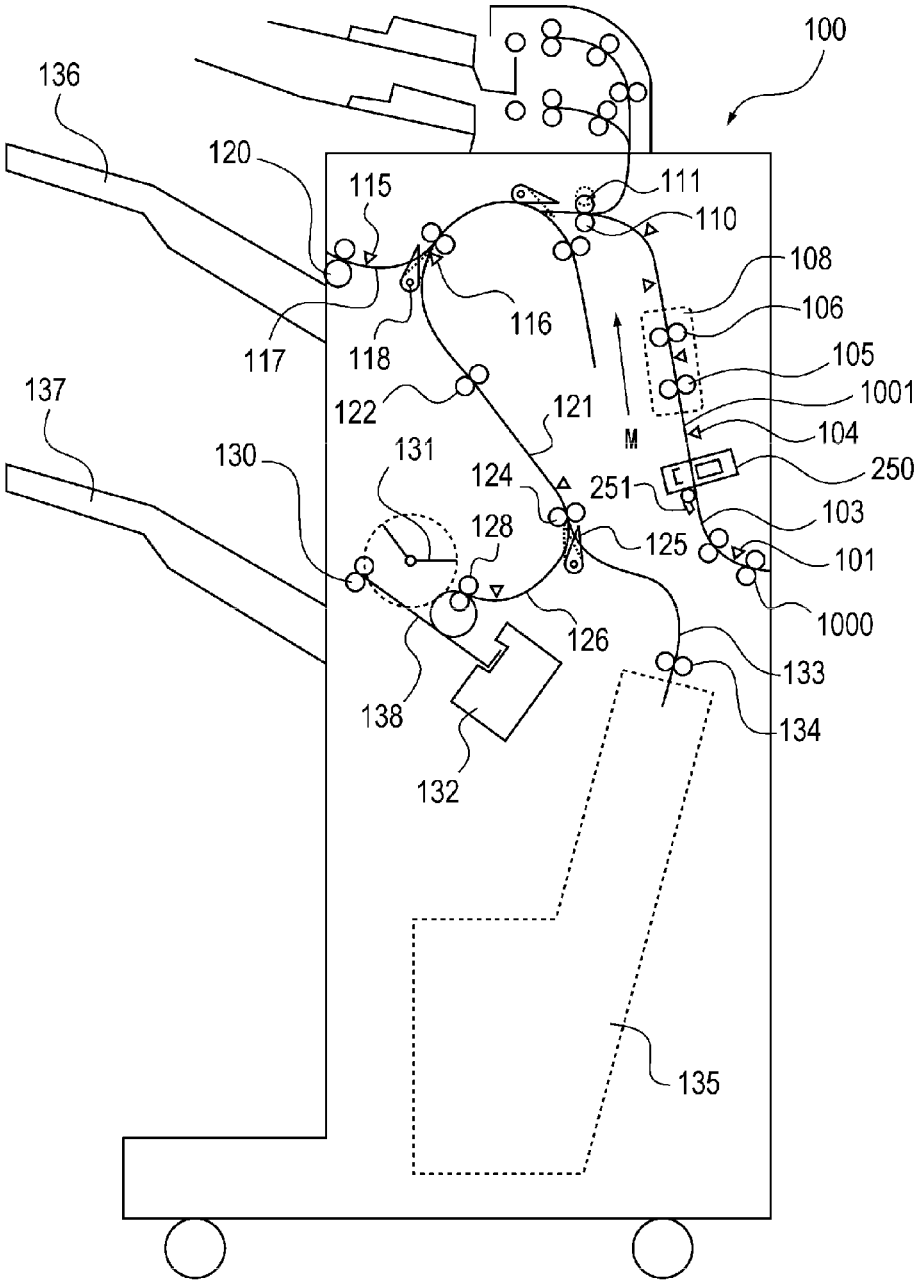
FIG. 2 is a sectional view illustrating a configuration of the sheet processing apparatus.

FIG. 2 is a sectional view illustrating a configuration of the sheet processing apparatus 100. The sheet S ejected from the apparatus main body 300A (see FIG. 1) is passed to a pair of inlet rollers 1000 of the sheet processing apparatus 100. At the same time, an inlet sensor 101 detects the timing to pass the sheet S.

The sheet S passes through a conveying path 103. The sheet S then allows its downstream end (front end) in the sheet conveying direction to touch a pair of shift rollers 105 in a resting state and is aligned with a nip line. The sheet S forms a loop along a conveying path 1001 between the pair of shift rollers 105 and the punch unit 250 to correct the skew feeding.

The pair of shift rollers 105 is then driven for a specified amount to convey the sheet S. A lateral registration detection sensor 104 detects the end position of the sheet S in a sheet width direction N (see FIG. 3A) orthogonal to a sheet conveying direction M. The result of the end position detection is used to find the amount of lateral registration misalignment from the center position of the sheet conveying direction M. A shift unit 108 moves the sheet S nearer to and farther from a viewer in FIG. 2 to correct the lateral misalignment (shift operation). The shift operation occurs while the pair of shift rollers 105 conveys the sheet S.

After the shift operation, the upstream end (rear end) of the sheet S in the sheet conveying direction reaches the vicinity of a rear end pressing member 251. The pair of shift rollers 105 then stops again. A rear end pressing motor 293 (see FIG. 6) then starts. The rear end pressing motor 293 is driven to rotate the rear end pressing member 251 counterclockwise. The rear end of the sheet S is pushed in the sheet conveying direction M to align the punch position.

The above-described shift operation (lateral registration correction) belongs to a known technology and a detailed description will not be repeated. A skew feeding alignment operation and a punch positioning operation will be described below in detail. The punch unit 250 can punch a hole in the sheet S as needed at the upstream end in the sheet conveying direction.

The sheet S is then conveyed through a conveying roller 110, a separating roller 111, and a pair of buffer rollers 115, and then is conveyed to an upper conveying path 117 or a bundle conveying path 121. A solenoid (not illustrated) positions an upper path selection member (flapper) 118 as illustrated with a dotted line in the drawing when the sheet S is guided to the upper conveying path 117. An upper discharge roller 120 discharges the sheet S to an upper tray 136.

The upper path selection member (flapper) 118 is positioned as illustrated with a solid line in the drawing when the sheet S is guided to the bundle conveying path 121. The sheet S passes through the bundle conveying path 121 inside through a pair of buffer rollers 122 and a pair of bundle conveying rollers 124. A solenoid (not illustrated) positions a saddle path selection member (flapper) 125 as illustrated with a dotted line in the drawing when the sheet S is saddle-stitched. The sheet S is conveyed to a saddle path 133. A pair of saddle inlet rollers 134 guides the sheet S to a saddle unit provided as the saddle stitching unit 135 for saddle stitching. The saddle stitching process is one of general processes and is beyond the theme of the present invention. Therefore, a detailed description will not be repeated.

To discharge the sheet S to a lower tray 137, the pair of bundle conveying rollers 124 and the saddle path selection member (flapper) 125 convey the sheet S to a lower path 126. A pair of lower discharge rollers 128 discharges the sheet S to an intermediate process tray 138. A returning portion including a paddle 131 and a knurled belt performs an aligning process on the intermediate process tray 138. A stapler 132 binds a sheet bundle as needed. A pair of bundle discharge rollers 130 discharges the sheet bundle to the lower tray 137.

Figure 3A:
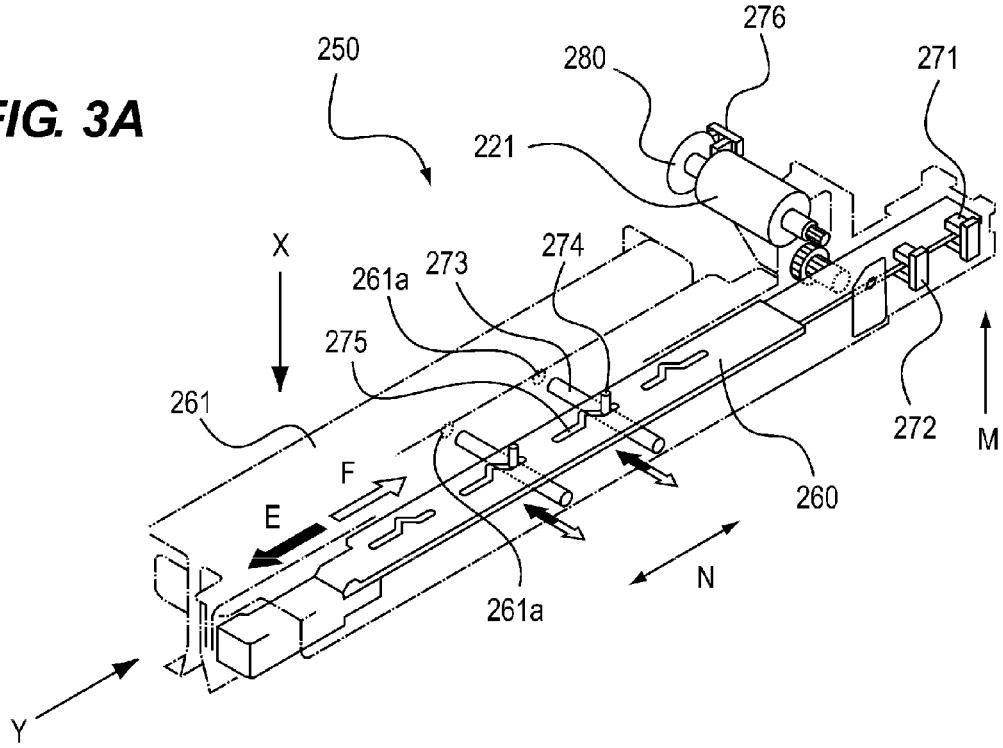
FIG. 3A is a perspective view illustrating a configuration of a punch unit.

FIG. 3A is a perspective view illustrating a configuration of the punch unit 250. The following describes punch positions for the punch unit 250 with reference to FIG. 3A. As illustrated in FIG. 3A, the punch unit 250 includes a first punch home position sensor (hereafter referred to as first sensor 271) and a second punch home position sensor (hereafter referred to as second sensor 272). The first sensor 271 and the second sensor 272 are provided as transmissive photointerrupters and determine the position of a slider 260.

As illustrated in FIG. 3A, for example, the slider 260 is positioned far from a viewpoint indicated by an arrow Y when part of the slider 260 is inserted into both the first sensor 271 and the second sensor 272 and interrupts the light. As will be described with reference to FIG. 5A, the slider 260 is positioned near to a viewpoint indicated by the arrow Y when part of the slider 260 is not inserted into both the first sensor 271 and the second sensor 272 and does not interrupt the light.

A punch motor 221 drives the slider 260. The drive direction of the punch motor 221 determines whether the slider 260 moves in the direction of an arrow E or F in FIG. 3A. For example, the slider 260 moves in the direction of the arrow E when the punch motor 221 is driven clockwise. A pin 274 fixed to a punch 273 moves along a guide slot 275 in a direction orthogonal to the moving direction of the slider 260.

An encoder 280 is fixed to a shaft opposite to the output shaft of the punch motor 221. The punch motor 221, when operated, allows the encoder 280 to generate a clock from a clock sensor 276 that is provided as a transmissive photointerrupter for the punch motor 221. Counting the clocks detects the amount of movement of the slider 260 the punch motor 221 operates. One punch operation is completed each time the slider 260 moves for a specified distance.

Figure 3B:
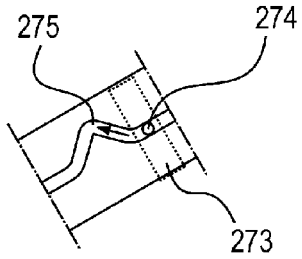
FIG. 3B is a partially enlarged plan view illustrating part of the configuration of a punch unit 250 viewed from an arrow X in FIG. 3A.

FIG. 3B is a partially enlarged plan view illustrating part of the configuration of a punch unit 250 viewed from an arrow X in FIG. 3A. As illustrated in FIG. 3B, the guide slot 275 includes a first linear portion 275*a*, a V-shaped portion 275*b*, and a second linear portion 275*c*. The pin 274 provided for the punch 273 moves along the first linear portion 275*a* toward the V-shaped portion 275*b*.

Figure 3C:
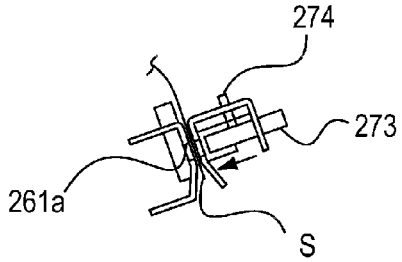
FIG. 3C is a partially enlarged sectional view illustrating part of the configuration of the punch unit 250 viewed from an arrow Y in FIG. 3A.

FIG. 3C is a partially enlarged sectional view illustrating part of the configuration of the punch unit 250 viewed from an arrow Y in FIG. 3A. FIG. 3B illustrates that the pin 274 is guided along the first linear portion 275*a* of the guide slot 275. In this case, as illustrated in FIG. 3C, the punch 273 moves while maintaining a specified distance to a hole 261a formed in a frame 261 (see FIG. 3A).

Figure 4A:
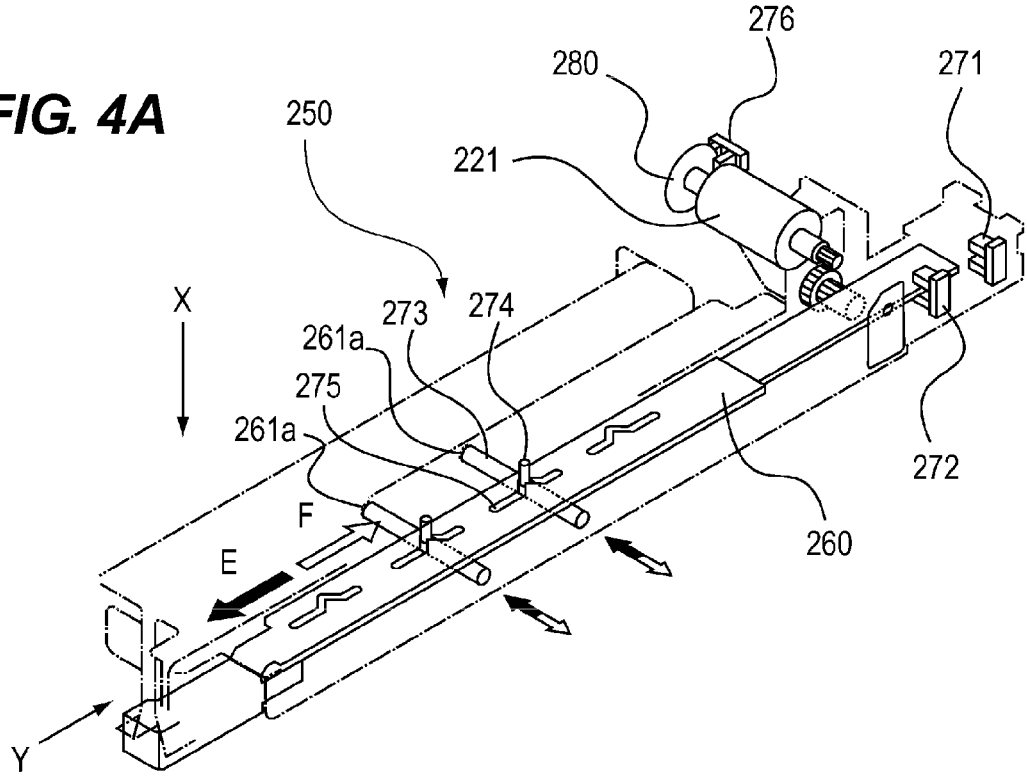
FIG. 4A is a perspective view illustrating a configuration of the punch unit.
Figure 4B:
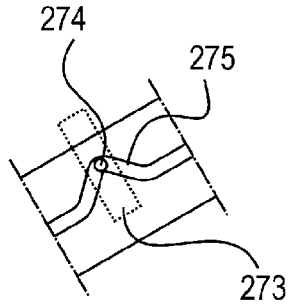
FIG. 4B is a partially enlarged plan view illustrating part of the configuration of the punch unit 250 viewed from an arrow X in FIG. 4A.

FIG. 4 is a perspective view illustrating a configuration of the punch unit 250 when the slider 260 of the punch unit 250 moves in the direction of the arrow E. As illustrated in FIG. 4A, the pin 274 is guided to the V-shaped portion 275*b* (see FIG. 4B) of the guide slot 275 when the slider 260 operates in the direction of the arrow E. The punch 273 accordingly interlocks with the pin 274 and moves perpendicularly to the surface of the sheet S to punch a hole. The punch 273 is inserted into the hole 261*a* that is formed in the frame 261 opposite the punch 273.

FIG. 4B is a partially enlarged plan view illustrating part of the configuration of the punch unit 250 viewed from an arrow X in FIG. 4A. As illustrated in FIG. 4B, the pin 274 moves to the tip of the V-shaped portion 275*b* of the guide slot 275 according to the operation of the slider 260.

Figure 4C:
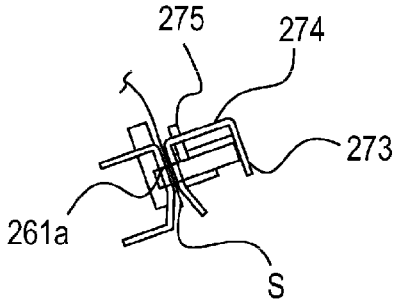
FIG. 4C is a partially enlarged sectional view illustrating part of the configuration of the punch unit 250 viewed from an arrow Y in FIG. 4A.

FIG. 4C is a partially enlarged sectional view illustrating part of the configuration of the punch unit 250 viewed from an arrow Y in FIG. 4A. As illustrated in FIG. 4C, the punch 273 punches a hole in the sheet S and is inserted into the hole 261a of the frame 261 according to the operation of the slider 260.

Figure 5A:
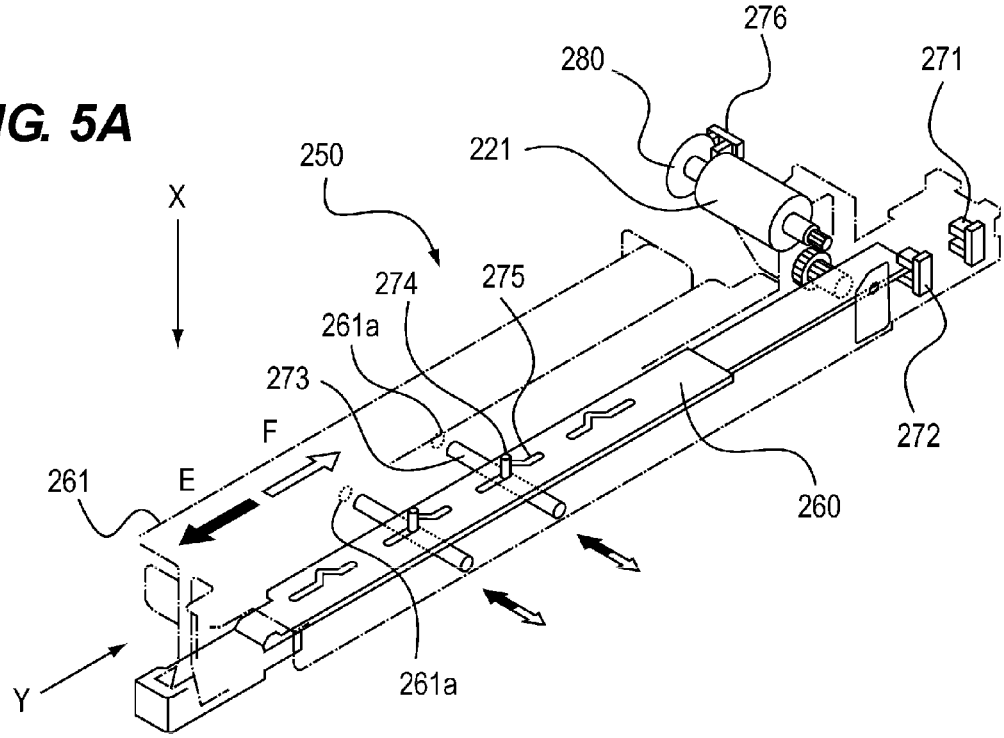
FIG. 5A is a perspective view illustrating a configuration of the punch unit.

FIG. 5A is a perspective view illustrating a configuration of the punch unit 250 when the slider 260 of the punch unit 250 further moves in the direction of the arrow E. The pin 274 is guided to the second linear portion 275*c* of the guide slot 275 when the slider 260 further moves in the direction of the arrow E as illustrated in FIG. 5A. The punch 273 interlocking with the pin 274 is accordingly pulled out of the hole 261*a* of the frame 261 and moves in a direction so as to be separated from the sheet S.

Figure 5B:
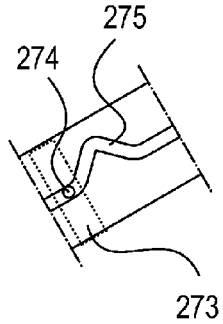
FIG. 5B is a partially enlarged plan view illustrating part of the configuration of the punch unit 250 viewed from an arrow X in FIG. 5A.

FIG. 5B is a partially enlarged plan view illustrating part of the configuration of the punch unit 250 viewed from an arrow X in FIG. 5A. The pin 274 moves along the second linear portion 275*c* of the guide slot 275 according to the operation of the slider 260 as illustrated in FIG. 5B.

Figure 5C:
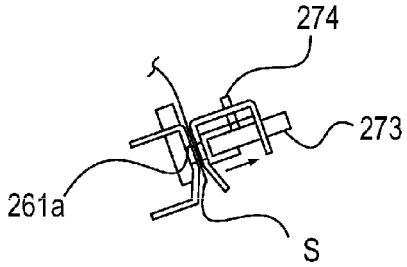
FIG. 5C is a partially enlarged sectional view illustrating part of the configuration of the punch unit 250 viewed from an arrow Y in FIG. 5A.

FIG. 5C is a partially enlarged sectional view illustrating part of the configuration of the punch unit 250 viewed from an arrow Y in FIG. 5A. The punch 273 is pulled out of the hole 261*a* of the frame 261 and is separated from the sheet S according to the operation of the slider 260 as illustrated in FIG. 5C.

Figure 6:
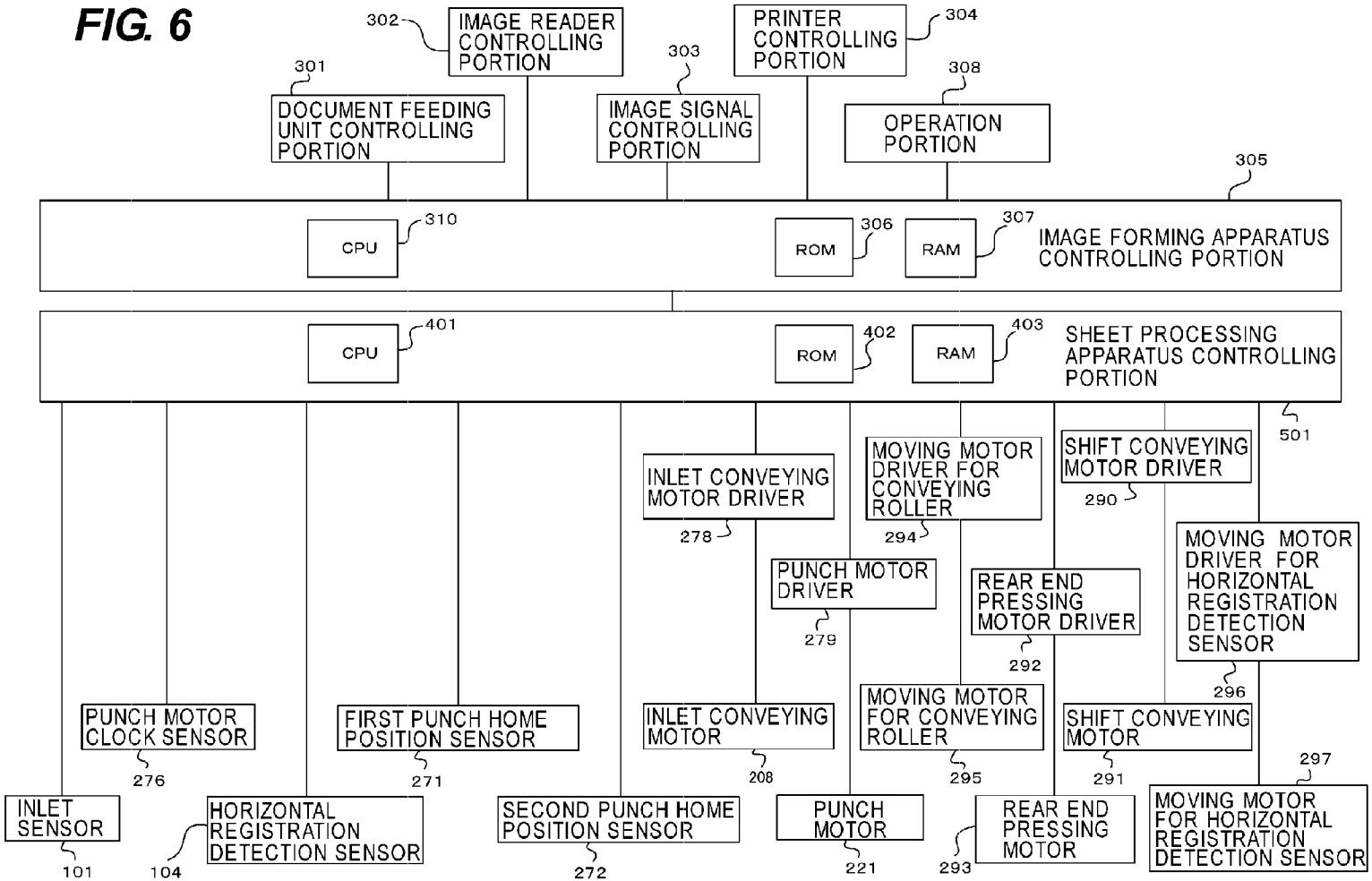
FIG. 6 is a control block diagram illustrating an image forming apparatus and the sheet processing apparatus.

FIG. 6 is a control block diagram illustrating the image forming apparatus 300 and the sheet processing apparatus 100. As illustrated in FIG. 6C, an image forming apparatus controlling portion 305 includes a CPU 310 and ROM 306 and RAM 307 as storage portions. A control program is stored in the ROM 306 and generally controls a document feeding unit controlling portion 301, an image reader controlling portion 302, an image signal controlling portion 303, a printer controlling portion 304, an operation portion 308, and a sheet processing apparatus controlling portion 501. The ROM 307 temporarily stores control data or stores data as an operational area for arithmetic processing according to the control.

The document feeding unit controlling portion 301 controls the automatic document feeding unit 500 (see FIG. 1) based on instructions from the image forming apparatus controlling portion 305. The image reader controlling portion 302 controls an optical system including a light source, a lens, and an imaging element. In addition, the image reader controlling portion 302 transfers an RGB analog image signal output from the imaging element to the image signal controlling portion 303. The image signal controlling portion 303 converts the RGB analog image signal into a digital signal, variously processes the digital signal, converts it into a video signal, and outputs it to the printer controlling portion 304. The image forming apparatus controlling portion 305 controls processing of the image signal controlling portion 303.

The operation portion 308 includes multiple keys and a display portion. The keys are used to configure various functions for image formation. The display portion displays information about setting states. A key signal corresponds to each key operation on the operation portion 308 and is supplied to the image forming apparatus controlling portion 305 functioning as a computation portion or an input portion. The operation portion 308 allows the display portion to display information corresponding to a signal from the image forming apparatus controlling portion 305.

The sheet processing apparatus controlling portion 501 is mounted on the sheet processing apparatus 100. The sheet processing apparatus controlling portion 501 exchanges data with the image forming apparatus controlling portion 305 to control operations of the sheet processing apparatus 100 through a communication IC (not illustrated). The sheet processing apparatus controlling portion 501 includes a CPU 401, ROM 402, and RAM 403. The CPU 401 controls various actuators and sensors based on a control program stored in the ROM 402.

For example, the sheet processing apparatus controlling portion 501 controls the inlet sensor 101, the pair of inlet rollers 1000, an inlet conveying motor 208 to drive a pair of conveying rollers 102, a shift conveying motor 291 to drive pairs of shift rollers 105 and 106. The sheet processing apparatus controlling portion 501 controls the inlet conveying motor 208 using an inlet conveying motor driver 278 and controls the shift conveying motor 291 using a shift conveying motor driver 290. The RAM 403 temporarily stores control data or is used as an operational area for arithmetic processing according to the control. The sheet processing apparatus controlling portion 501 also controls the inlet sensor 101, the clock sensor 276 for the punch motor 221, the lateral registration detection sensor 104, the first sensor 271, and the second sensor 272. The sheet processing apparatus controlling portion 501 controls the punch motor 221 using a punch motor driver 279 and controls a moving motor 295 for the conveying roller using a moving motor driver 294 for the conveying roller. In addition, the sheet processing apparatus controlling portion 501 controls the rear end pressing motor 293 using a rear end pressing motor driver 292 and controls a moving motor 297 for the lateral registration detection sensor 104 using a moving motor driver 296 for the lateral registration detection sensor 104.

Figure 7:
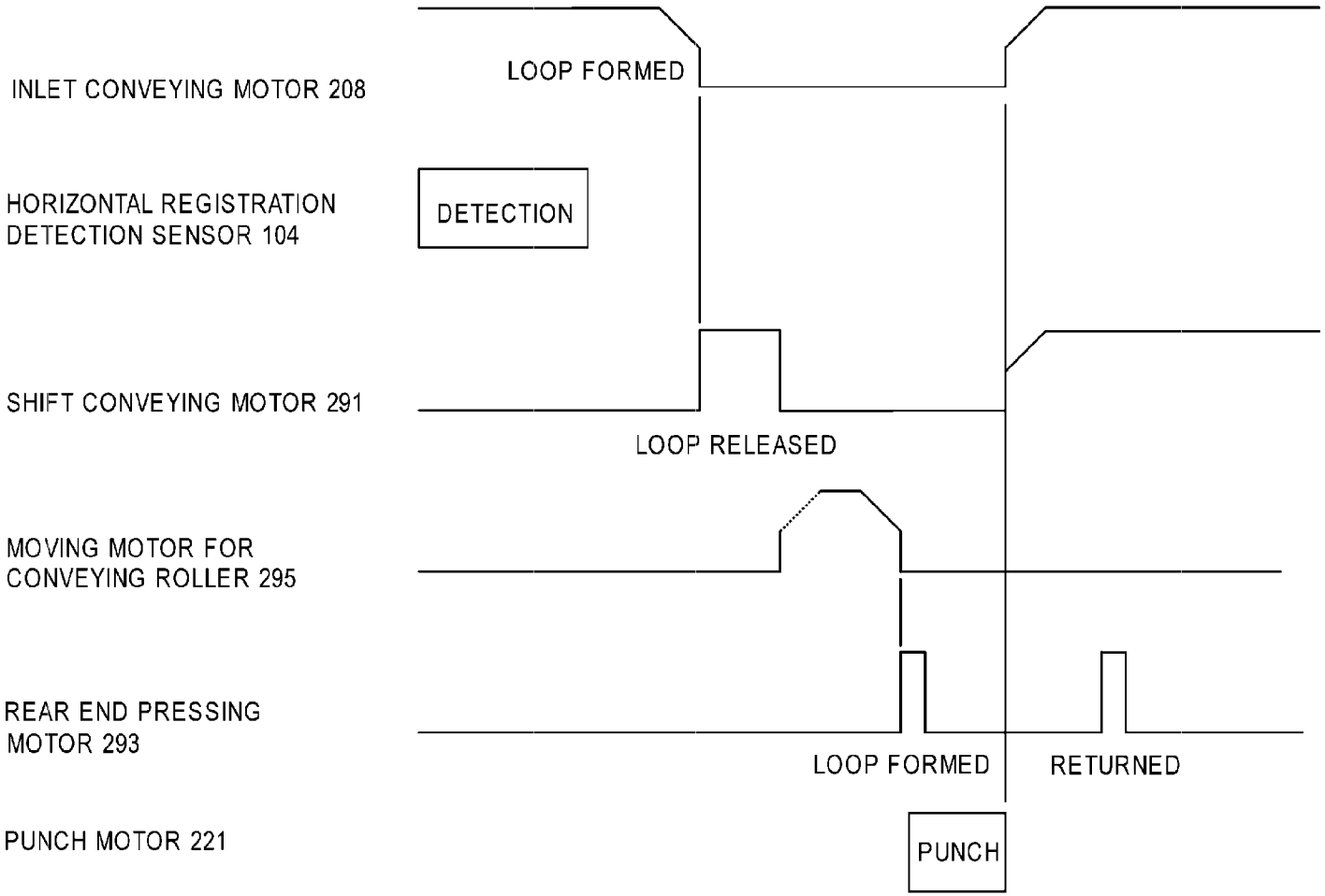
FIG. 7 is a timing chart illustrating timings, from the time a sheet is fed to the sheet processing apparatus and a hole is punched in the sheet, to the time the sheet is conveyed downstream in a sheet conveying direction for the sheet processing apparatus.

FIG. 7 is a timing chart illustrating timings, from the time the sheet S is fed to the sheet processing apparatus 100 and a hole is punched, to the time the sheet S is conveyed downstream in a sheet conveying direction M for the sheet processing apparatus 100. As illustrated in FIG. 7, the sheet processing apparatus controlling portion 501 drives the inlet conveying motor 208 to rotate the pair of inlet rollers 1000 and the pair of conveying rollers 102. The sheet S forms a loop (first loop L1) when the downstream end of the sheet S in the sheet conveying direction abuts the pair of shift rollers 105 and the upstream end of the sheet S in the sheet conveying direction advances. The sheet processing apparatus controlling portion 501 stops driving the inlet conveying motor 208. The sheet S passes through the pair of inlet rollers 1000 and makes contact with the pair of shift rollers 105. Meanwhile, the sheet processing apparatus controlling portion 501 controls the lateral registration detection sensor 104 to detect the lateral registration at the end of the sheet S in the sheet width direction N.

The sheet processing apparatus controlling portion 501 controls the shift conveying motor 291 to rotate the pair of shift rollers 105. The sheet S advances while the pair of shift rollers 105 nips the downstream end of the sheet S in the sheet conveying direction M. The loop (first loop L1) of the sheet S is released.

The sheet processing apparatus controlling portion 501 controls the moving motor 295 for conveying roller movement to move the shift unit 108 in the sheet width direction N and correct the lateral registration. The sheet processing apparatus controlling portion 501 controls the rear end pressing motor 293 to rotate the rear end pressing member 251 and press the downstream end of the sheet S in the sheet conveying direction M. The sheet S again forms a loop (second loop L2).

The sheet processing apparatus controlling portion 501 controls the punch motor 221 to punch a hole in the sheet S using the punch unit 250. The sheet processing apparatus controlling portion 501 then controls the rear end pressing motor 293 to rotate the rear end pressing member 251 in the reverse direction and return the rear end pressing member 251 to the original rotation position.

Figure 8:
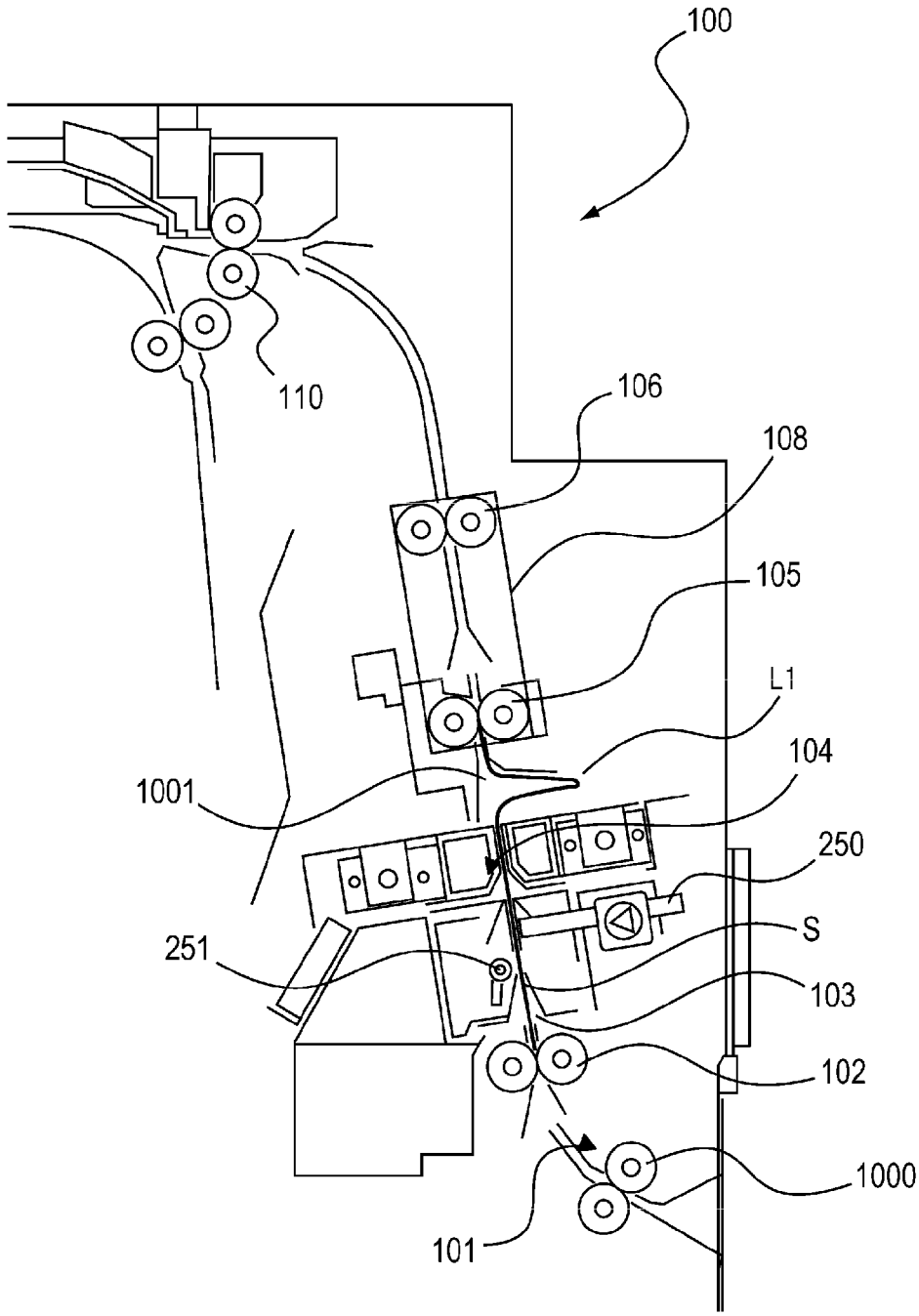
FIG. 8 is a sectional view illustrating a process of correcting skew feeding of a sheet in the sheet processing apparatus.

FIG. 8 is a sectional view illustrating a process of correcting skew feeding of the sheet S in the sheet processing apparatus 100. The pair of shift rollers 105 in FIG. 8 is provided and is capable of conveying the sheet S in the sheet conveying direction M and the sheet width direction N orthogonal to the sheet conveying direction M. The pair of conveying rollers 102 is positioned upstream of the pair of shift rollers 105 and the rear end pressing member 251 in the sheet conveying direction M. The pair of conveying rollers 102 is provided as a conveying portion and conveys the sheet S in the sheet conveying direction M.

Based on this configuration, the inlet conveying motor 208 (see FIG. 6) is driven to rotate the pair of conveying rollers 102. The sheet S abuts the pair of shift rollers 105 when the pair of conveying rollers 102 conveys the sheet S. The pair of shift rollers 105 stops. The downstream end of the sheet S in the sheet conveying direction is aligned to the nip line. In this state, the pair of conveying rollers 102 conveys the sheet S in a predetermined time and then stops the conveyance. The first loop L1 is formed along the conveying path 1001 to correct skew feeding at the downstream end of the sheet S in the sheet conveying direction. In this manner, the skew feeding of the sheet S is corrected because the sheet S forms the first loop L1 when the pair of shift rollers 105 stops and the pair of conveying rollers 102 is driven.

Figure 9:
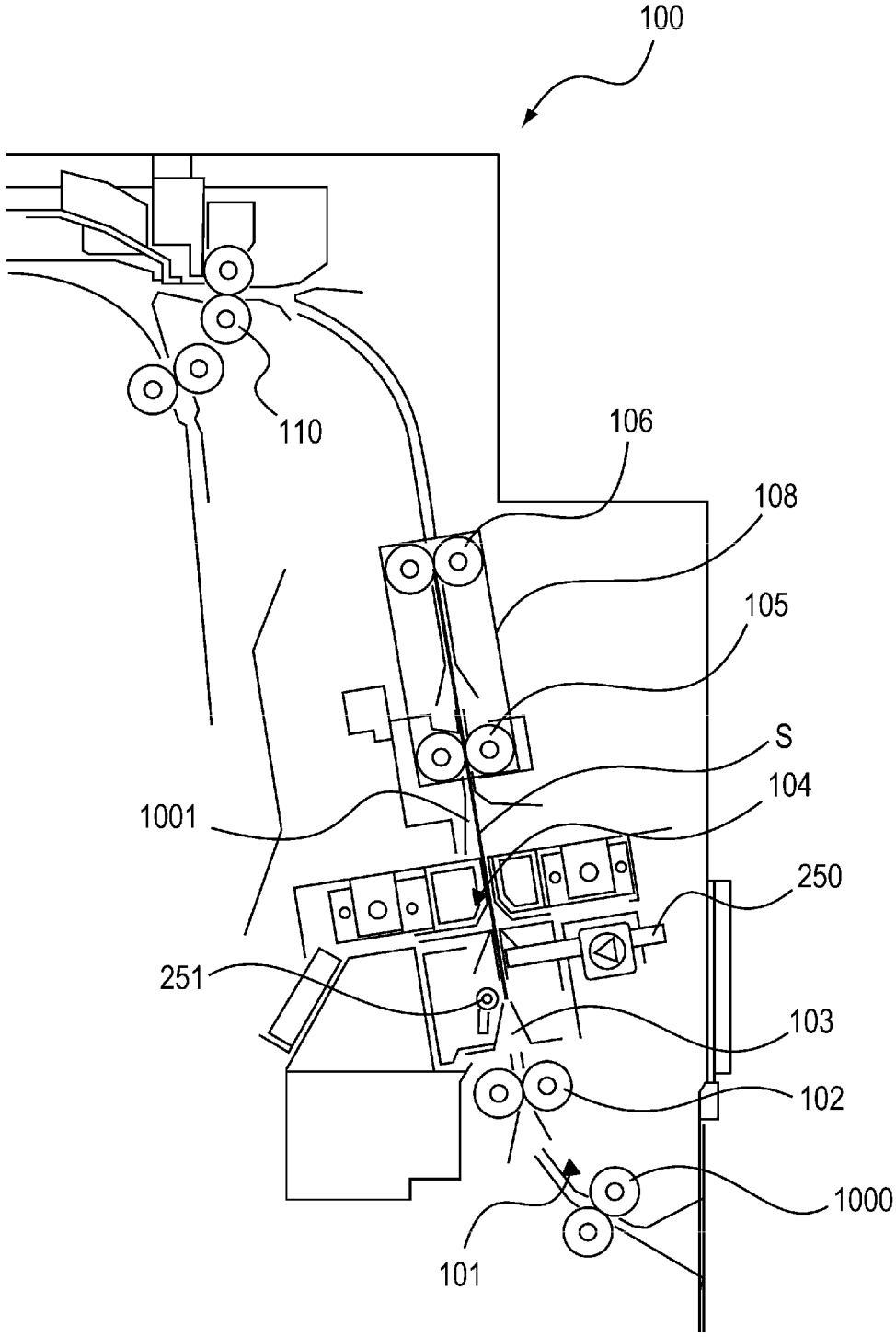
FIG. 9 is a sectional view illustrating a process of releasing a sheet loop after skew feeding of the sheet is corrected in the sheet processing apparatus.

FIG. 9 is a sectional view illustrating a process of releasing the first loop L1 of the sheet S after skew feeding of the sheet S is corrected in the sheet processing apparatus 100 due to formation of the first loop L1. The shift unit 108 illustrated in FIG. 9 is provided as a moving portion and moves the pair of shift rollers 105 and the pair of conveying rollers 106 in the sheet width direction N orthogonal to the sheet conveying direction M. The shift unit 108 moves the pair of shift rollers 105 and the pair of conveying rollers 106 in the sheet width direction N to correct the lateral registration of the sheet S.

Under the situation in FIG. 8, the shift conveying motor 291 (see FIG. 6) is driven to rotate the pair of shift rollers 105. As illustrated in FIG. 9, the pair of shift rollers 105 further conveys the sheet S to release the first loop L1 formed along the conveying path 1001. The shift conveying motor 291 (see FIG. 6) stops to stop the pair of shift rollers 105 when the upstream end of the sheet S in the sheet conveying direction reaches the vicinity of the rear end pressing member 251. Simultaneously with the stop of the shift conveying motor 291, the moving motor 295 (see FIG. 6) moves the shift unit 108 in the sheet width direction N to correct the lateral registration. The sheet width direction N in which the shift unit 108 is moved is equivalent to the direction far from or near to a viewpoint in FIG. 9.

Figure 10:
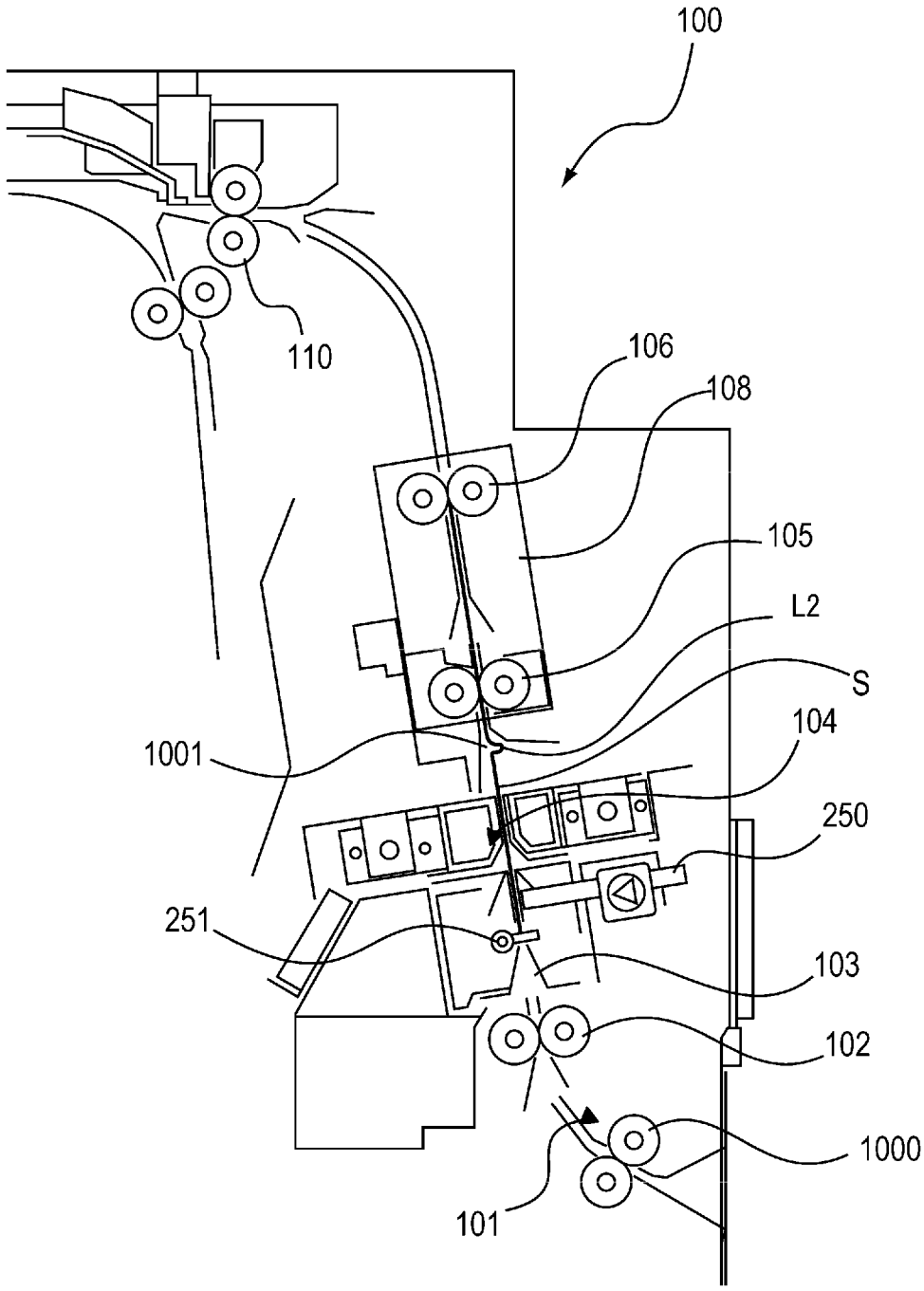
FIG. 10 is a sectional view illustrating a process of sheet punch positioning in the sheet processing apparatus.

FIG. 10 is a sectional view illustrating a process of punch positioning on the sheet S in the sheet processing apparatus 100. The punch unit 250 in FIG. 10 is provided as a punching portion and punches a hole in the sheet S. The rear end pressing member 251 is provided as a pressing portion and positions the sheet S against the punch unit 250. The pair of shift rollers 105 stops for the correction. At the same time, the rear end pressing member 251 projects to the conveying path for the sheet S and presses the upstream end of the sheet S toward the downstream in the sheet conveying direction M. The rear end pressing member 251 forms the second loop L2 for the sheet S on the conveying path 1001 to correct the skew feeding and align the sheet S with the punch position of the punch unit 250. As illustrated in FIG. 10, the punch unit 250 is positioned upstream of the pair of shift rollers 105 in the sheet conveying direction M. The rear end pressing member 251 is positioned upstream of the punch unit 250 in the sheet conveying direction M.

Under the situation in FIG. 9, the rear end pressing motor 293 (see FIG. 6) is driven for a predetermined time to rotate the rear end pressing member 251 counterclockwise. As illustrated in FIG. 10, the rear end pressing member 251 presses the rear end of the sheet S to form a loop (second loop L2) again along the conveying path 1001. This corrects the skew feeding at the upstream end of the sheet S in the sheet conveying direction. This also enables positioning at the rear end of the sheet for punching a hole. The punch unit 250 punches a hole in the sheet S that is then conveyed downstream in the sheet conveying direction M.

Figure 11:
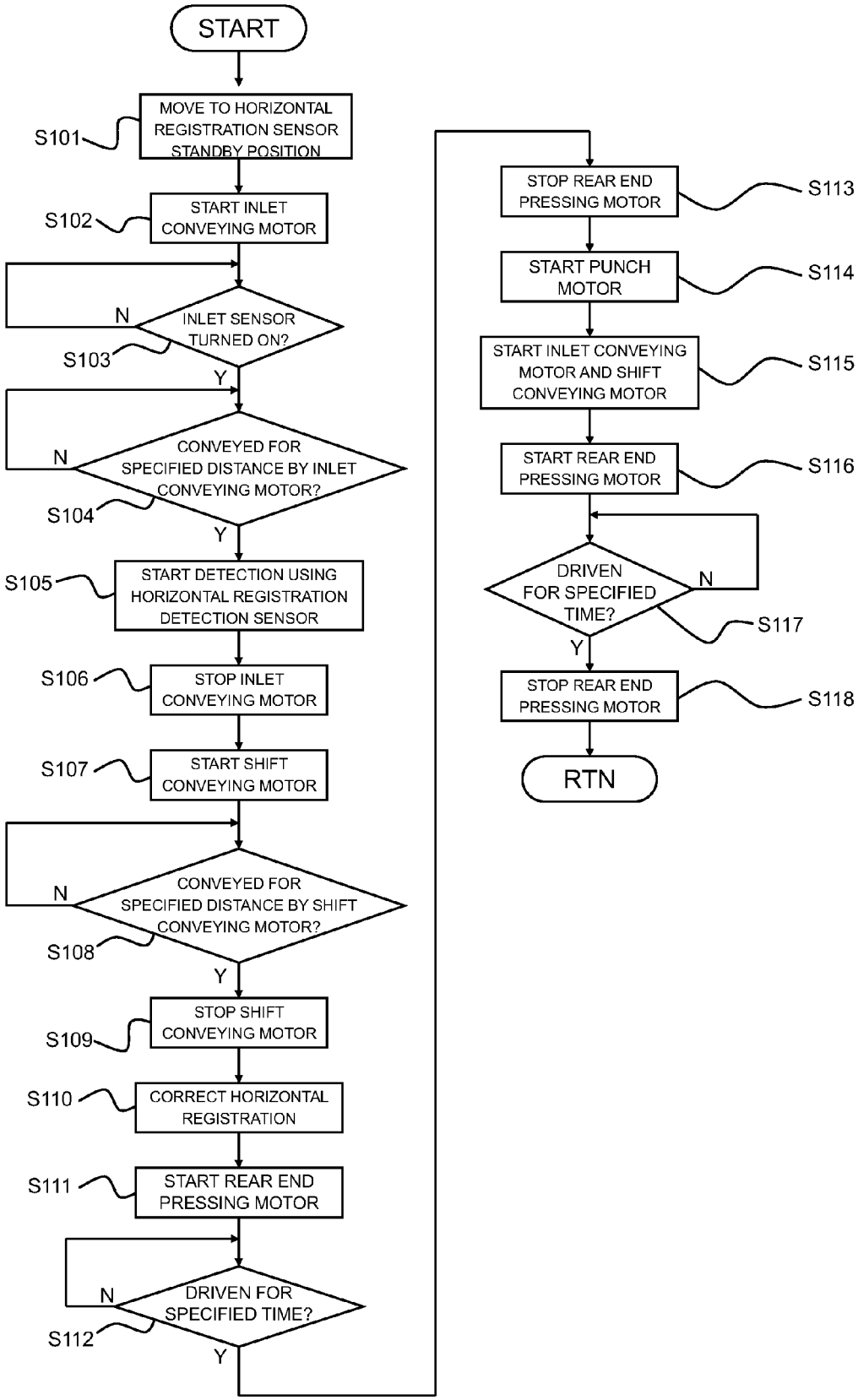
FIG. 11 is a flowchart illustrating a control process of a controller.

FIG. 11 is a flowchart illustrating a control process of the sheet processing apparatus controlling portion 501. The CPU 401 drives the moving motor 297 to move the lateral registration detection sensor 104 to a stand-by position (Step 101 or S101 and so on hereafter). The CPU 401 then starts the inlet conveying motor 208 (S102).

The CPU 401 determines whether the inlet sensor 101 is turned on (S103). When the determination in step S103 results in YES, the CPU 401 drives the inlet conveying motor 208 and determines whether the sheet S is conveyed for a predetermined distance (S104). When the determination in step S103 results in NO, the CPU 401 repeats the control process in step S103.

When the determination in step S104 results in YES, the CPU 401 drives the moving motor 297 and allows the lateral registration detection sensor 104 to detect a side end of the sheet S (S105). When the determination in step S104 results in NO, the CPU 401 repeats the control process in step S104.

After the control process in step S105, the CPU 401 stops the inlet conveying motor 208 (S106). The sheet S accordingly forms a loop (first loop L1) along the conveying path 1001. The CPU 401 then starts the shift conveying motor 291 to drive the pair of shift rollers 105 (S107).

The CPU 401 determines whether the shift conveying motor 291 conveys the sheet S for a predetermined distance (S108). When the determination in step S108 results in YES, the CPU 401 stops the shift conveying motor 291 again (S109). When the determination in step S108 results in NO, the CPU 401 repeats the control process in step S108.

After the control process in step S109, the CPU 401 allows the moving motor 295 to drive the shift unit 108 and correct the lateral registration based on a detection result from the lateral registration detection sensor 104 in step S105 (S110). The CPU 401 starts the rear end pressing motor 293 to drive the rear end pressing member 251 (S111).

The CPU 401 determines whether the rear end pressing motor 293 is driven for a predetermined time (S112). When the determination in step S112 results in YES, the CPU 401 stops the rear end pressing motor 293 (S113). The sheet S accordingly forms a loop (second loop L2). When the determination in step S112 results in NO, the CPU 401 repeats the control process in step S112.

In this state, the CPU 401 starts the punch motor 221 and allows the punch unit 250 to punch a hole in the sheet S at the rear end (S114). After the punch, the CPU 401 restarts the shift conveying motor 291 to drive the pairs of shift rollers 105 and 106 and convey the sheet S downstream and also restarts the inlet conveying motor 208 (S115). The CPU 401 drives the pair of inlet rollers 1000 and the pair of conveying rollers 102 so as to be able to receive the sheet S (S115). The CPU 401 then restarts the rear end pressing motor 293 (S116).

The CPU 401 determines whether the rear end pressing motor 293 is driven for a predetermined time (S117). When the determination in step S117 results in YES, the CPU 401 returns the rear end pressing member 251 to the stand-by position and stops the rear end pressing motor 293 (S118). When the determination in step S117 results in NO, the CPU 401 repeats the control process in step S117.

The above-described process can correct the skew feeding for the sheet S without switching back the sheet S, shorten the punch time, and improve the productivity. In addition, the process can position the sheet punching and remarkably improve the sheet correction accuracy.

According to the embodiment, the pair of shift rollers 105 stops and the pair of conveying rollers 102 is driven to form the first loop L1 on the sheet S. This corrects the skew feeding at the downstream end of the sheet S in the sheet conveying direction. The pair of shift rollers 105 stops and the rear end pressing member 251 is driven to form the second loop L2. This corrects the skew feeding at the upstream end of the sheet S in the sheet conveying direction. As a result, the embodiment can shorten the time to correct the skew feeding for the sheet S and punch a hole. The rear end pressing member 251 allows the sheet S to form the second loop L2 and eliminates the need to retract the sheet S upstream in the sheet conveying direction M.

The present invention forms the first loop L1 to correct skew feeding at the downstream end of a sheet in the sheet conveying direction and forms the second loop L2 to correct skew feeding at the upstream end of a sheet in the sheet conveying direction. As a result, the invention can shorten the time to correct the skew feeding for the sheet and punch a hole.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-167848, filed Jul. 27, 2010, which is hereby incorporated by reference herein in its entirety.

What is claimed is:

1. A sheet processing apparatus comprising:

a conveying portion which conveys a sheet;

a pair of shift rollers which nips and conveys the sheet conveyed by the conveying portion and is capable of moving in a sheet width direction orthogonal to a sheet conveying direction to move the sheet in the sheet width direction;

a moving portion which moves the pair of shift rollers in the sheet width direction;

a punching portion which punches a hole at an upstream end portion of the sheet in the sheet conveying direction;

a pressing portion which presses an upstream end of the sheet in the sheet conveying direction; and a controller configured to control a skew correction operation and a punch positioning operation so that after a first loop is formed on the sheet to correct skew of the sheet while the sheet is conveyed by the conveying portion with its downstream end in the sheet conveying direction abutted against the pair of shift rollers, the pair of shift rollers conveys the sheet to release the first loop, and then the pressing portion presses an upstream end of the sheet, nipped by the pair of shift rollers, in the sheet conveying direction to correct skew of the sheet by forming a second loop on the sheet and to position the upstream end of the sheet with reference to the punching portion after the moving portion moves the pair of shift rollers in the sheet width direction to correct lateral registration of the sheet.

2. The sheet processing apparatus according to claim 1, wherein the punching portion is placed upstream of the pair of shift rollers in the sheet conveying direction, and the pressing portion is placed upstream of the punching portion in the sheet conveying direction.

3. The sheet processing apparatus according to claim 2, wherein the pressing portion projects to a sheet conveying path and presses an upstream end of the sheet downstream in the sheet conveying direction.

4. The sheet processing apparatus according to claim 3, wherein the conveying portion is provided upstream of the pressing portion in the sheet conveying direction, the pair of shift rollers stops and the conveying portion is driven to form the first loop of the sheet, and the pair of shift rollers stops and the pressing portion is driven to form the second loop of the sheet.

5. An image forming apparatus comprising:

an image forming portion which forms an image;

a conveying portion which conveys a sheet;

a pair of shift rollers which nips and conveys the sheet conveyed by the conveying portion and is capable of moving in a sheet width direction orthogonal to a sheet conveying direction to move the sheet in the sheet width direction;

a moving portion which moves the conveying portion in the sheet width direction;

a punching portion which punches a hole at an upstream end portion of the sheet in the sheet conveying direction;

a pressing portion which presses an upstream end of the sheet in the sheet conveying direction; and a controller configured to control a skew correction operation and a punch positioning operation so that after a first loop is formed on the sheet to correct skew of the sheet while the sheet is conveyed by the conveying portion with its downstream end in the sheet conveying direction abutted against the pair of shift rollers, the conveying portion conveys the sheet to release the first loop, and then the pressing portion presses an upstream end of the sheet, nipped by the pair of shift rollers, in the sheet conveying direction to correct skew of the sheet by forming a second loop on the sheet and to position the upstream end of the sheet with reference to the punching portion after the moving portion moves the pair of shift rollers in the sheet width direction to correct lateral registration of the sheet.

6. The image forming apparatus according to claim 5, wherein the punching portion is placed upstream of the pair of shift rollers in the sheet conveying direction, and the pressing portion is placed upstream of the punching portion in the sheet conveying direction.

7. The image forming apparatus according to claim 6, wherein the pressing portion projects to a sheet conveying path and presses an upstream end of the sheet downstream in the sheet conveying direction.

8. The image forming apparatus according to claim 7, wherein the conveying portion is provided upstream of the pressing portion in the sheet conveying direction, the pair of shift rollers stops and the conveying portion is driven to form the first loop of the sheet, and the pair of shift rollers stops and the pressing portion is driven to form the second loop of the sheet.

* * * * *